United States Patent [19]

Kinshofer

[11] Patent Number: 4,695,086

[45] Date of Patent: Sep. 22, 1987

[54] TWO-SIDED GRAB BUCKET WITH PLURAL OPERATING CYLINDERS

[76] Inventor: Alfred Kinshofer, Wendelsteinstrasse 8, 8160 Miesbach, Fed. Rep. of Germany

[21] Appl. No.: 773,640

[22] Filed: Sep. 9, 1985

[51] Int. Cl.[4] ..... B66C 3/02

[52] U.S. Cl. ..... 294/68.23; 294/88; 37/186; 92/111; 92/151

[58] Field of Search ..... 37/183 R, 183 A, 184–188; 294/68.23, 88; 92/111, 112, 117 A, 117 R, 66, 151

[56] References Cited

U.S. PATENT DOCUMENTS

| | | | |
|---|---|---|---|
| 295,159 | 3/1884 | Fitts et al. | 92/117 A X |
| 3,413,029 | 11/1968 | Donovan | 294/68.23 X |
| 4,080,870 | 3/1978 | Lusby | 92/111 X |
| 4,405,167 | 9/1983 | Kinshofer | 37/187 X |

FOREIGN PATENT DOCUMENTS

| | | | |
|---|---|---|---|
| 647856 | 7/1937 | Fed. Rep. of Germany | 37/186 |
| 802999 | 2/1951 | Fed. Rep. of Germany | 294/68.23 |
| 1028392 | 2/1953 | France | 37/186 |

*Primary Examiner*—Clifford D. Crowder

*Attorney, Agent, or Firm*—Howard C. Miskin

[57] ABSTRACT

A two-sided grab bucket comprises a U-shaped scoop carrier and two scoops, which are provided with crosspieces, which are welded to the inside surfaces of the upper edge portions of the side walls of the scoops and are pivoted to the legs of the scoop carrier on two spaced apart parallel axes, actuating levers, which are welded to the crosspieces, and a transversely extending hydraulic piston-cylinder unit, which is pivoted to and connects the free ends of said levers. The hydraulic piston-cylinder unit comprises two cylinders, each of which is pivoted to the actuating lever or levers associated with a crosspiece, and the pistons associated with said cylinders are interconnected by a common piston rod.

5 Claims, 11 Drawing Figures

Fig. 1
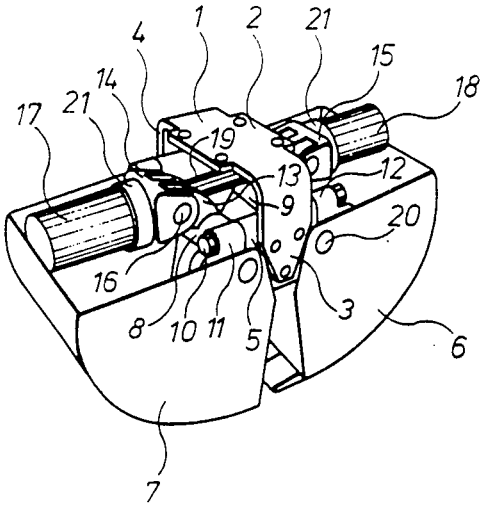
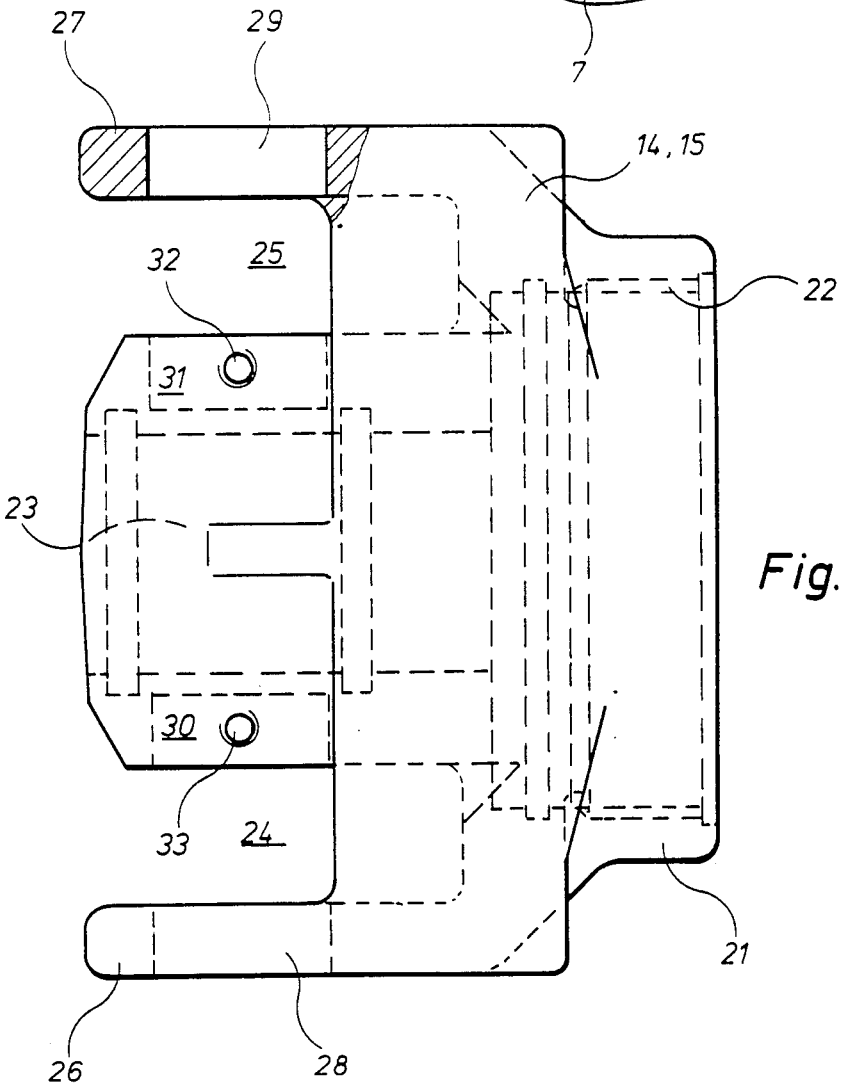
Fig. 2

Fig. 9
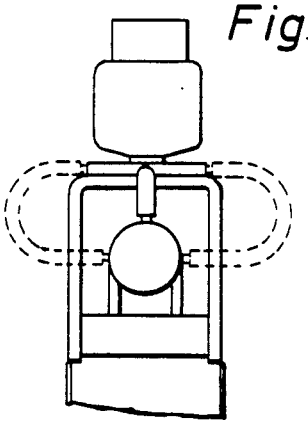
Fig. 7
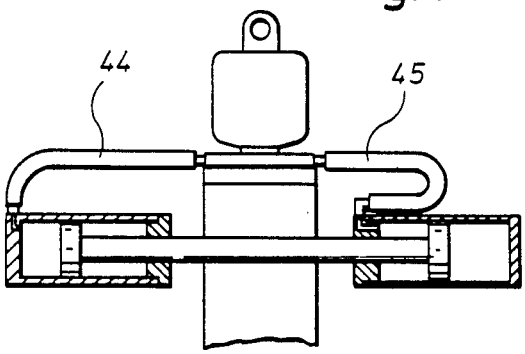
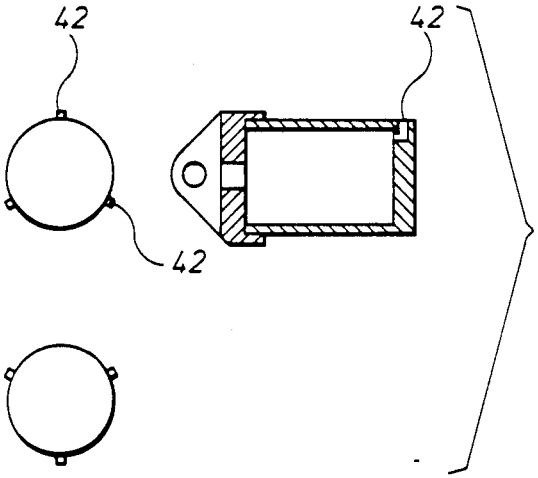
Fig. 8
Fig. 11
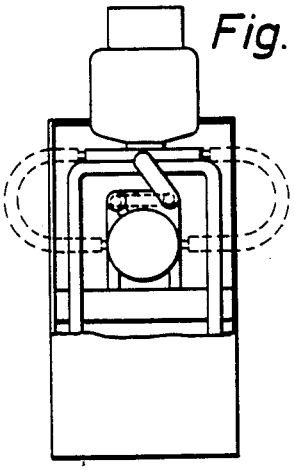
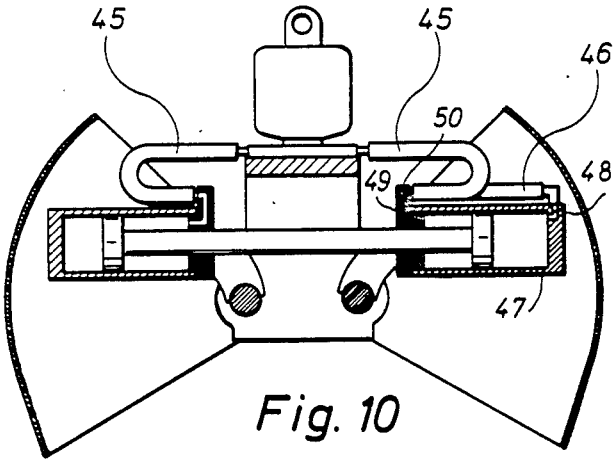
Fig. 10

TWO-SIDED GRAB BUCKET WITH PLURAL OPERATING CYLINDERS

BACKGROUND OF THE INVENTION

1. Field of the Invention

This invention comprises a two-sided grab bucket comprising a U-shaped scoop carrier and two scoops, which are provided with crosspieces, which are welded to the inside surfaces of the upper edge portions of the side walls of the scoops and are pivoted to the legs of the scoop carrier on two spaced apart parallel axes, actuating levers, which are welded to the crosspieces, and a transversely extending hydraulic piston-cylinder unit, which is pivoted to and connects the free ends of said levers.

2. Description of the Prior Art

A two-sided grab bucket of that kind, comprising a transversely extending hydraulic piston-cylinder unit, is known from Published German Application No. 30 37 866 which corresponds to U.S. Pat. No. 4,405,167 granted Sept. 20, 1983 to A. Kinshoffer.

In an open position, grab buckets should have a mouth clearance which is as small as possible so that they can be used also in narrow spaces, such as containers, trenches or the like. To ensure that the grab buckets have the largest possible capacity, the spacing of the pivotal axes for the scoops must be minimized. A grab bucket having a transverse piston-cylinder unit must meet a number of requirements, which can be fulfilled only with difficulty if the grab bucket should have the largest possible capacity, the smallest possible mouth clearance and the smallest possible width. In order to minimize the width of the grab bucket, i.e., the spacing of the side walls of the scoops, the pivots of the piston-cylinder unit must lie in a vertical plane because parts of the opening and closing mechanism cannot move past each other unless the width is increased in an undesirable manner.

In order to ensure that the scoops can be opened to an angle of about 80°, as is required for a satisfactory function, the spacing of the pivotal axes of the scoops must be as large as possible. But a large spacing of the pivotal axes will involve a smaller capacity of the grab bucket, which will not have an adequate capacity unless the pivotal axes are only closely spaced apart.

To provide a grab bucket having a small overall height, the lengths of the actuating levers must be minimized so that the scoops can be opened to the largest possible mouth clearance by a small displacement of the pisto-cylinder unit. It must be borne in mind that the piston-cylinder unit when it is in its lowermost position must not collide with the preferably tubular members used to stiffen and/or to mount the scoops.

The two-sided grab bucket disclosed in the aforesaid U.S. Pat. No. 4,405,167 cannot be as compact as may be desired because it must be ensured that the cylinders will not strike against the sleeves provided for stiffening and mounting the scoops during the closing of the scoops.

SUMMARY OF THE INVENTION

It is an object of the invention to provide a two-sided grab bucket which is of the kind described first hereinbefore and in which the piston-cylinder unit does not restrict the reduction in size of the grab bucket and the reduction of its mouth clearance.

This object is accomplished in accordance with the invention in that the hydraulic piston-cylinder unit comprises two cylinders, each of which is pivoted to the actuating lever or levers associated with a crosspiece, and the pistons associated with said cylinders are interconnected by a common piston rod. In the two-sided grab bucket in accordance invention the dimension which should be minimized to preclude a collision of the piston-cylinder unit and the crosspieces for mounting and stiffening the scoops is not constituted by the diameter of the cylinders but by the much smaller diameter of the piston rod. The piston rod may be so closely approached to the crosspieces that the piston rod is just short of the crosspieces when the grab bucket is closed. This permits the provision of a grab bucket which has a small overall height and a large mouth clearance.

In accordance with a preferred feature of the invention a large mouth clearance of the scoops will be obtained if the crossbeams mounting the scoops are closely approached to each other because the cylinders carry head pieces, which are provided with yokelike recesses on both sides of the guide for the piston rod, walls defining each of said recesses are formed with transverse bores for two pins, and the ends of two actuating levers welded to each crosspiece are pivoted to said pins.

In a preferred embodiment, one cylinder is provided adjacent to its outer end and the other cylinder is provided adjacent to its head with a bore for supplying and discharging the hydraulic liquid, and the piston rod has two axial bores, one of which interconnects the chambers disposed behind the pistons and the other of which interconnects the chambers in front of the pistons. That arrangement will permit an elimination of two hoses so that the risk of damage to hoses will be reduced. Such risk will be particularly high if the hoses protrude.

BRIEF DESCRIPTION OF THE DRAWING

FIG. 1 is a perspective view showing a two-sided grab bucket.

FIG. 2 is a top plan view showing a head piece of one of the actuating cylinders.

FIG. 7 is a view that is similar to FIG. 6 and shows on a smaller scale the piston-cylinder unit with hydraulic hoses connected to the unit.

FIG. 8 is a longitudinal sectional view showing a cylinder which is provided at its rear end with ports which are spaced 120° apart.

FIG. 9 is a side elevation showing the piston-cylinder unit illustrated in FIG. 7.

FIG. 10 is a sectional view showing a two-sided grab bucket in which the hydraulic hoses are connected to the head ends of the cylinders.

FIG. 11 is a side elevation showing the two-sided grab bucket illustrated in FIG. 10.

DETAILED DESCRIPTION OF THE PREFERRED EMBODIMENTS

Figure 3:
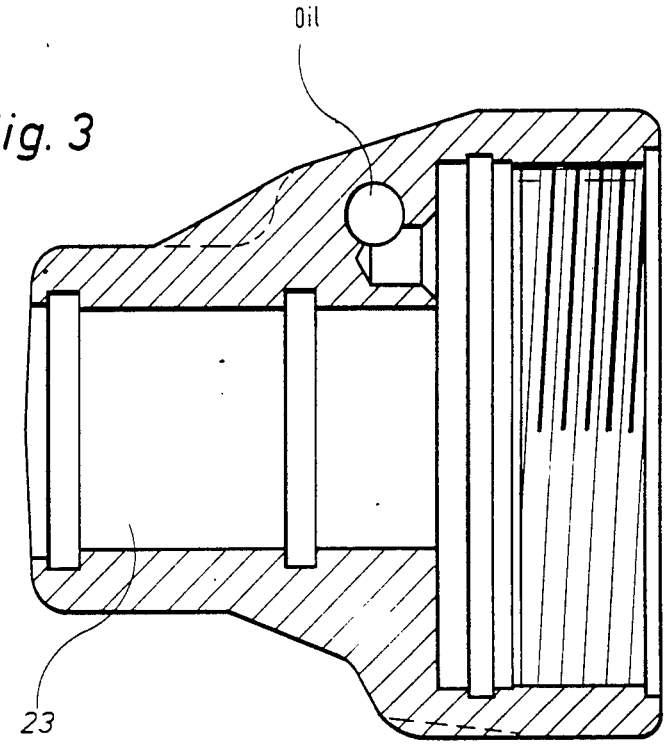
FIG. 3 is a sectional view taken on line A—A in FIG. 2 and showing the head piece.
Figure 4:
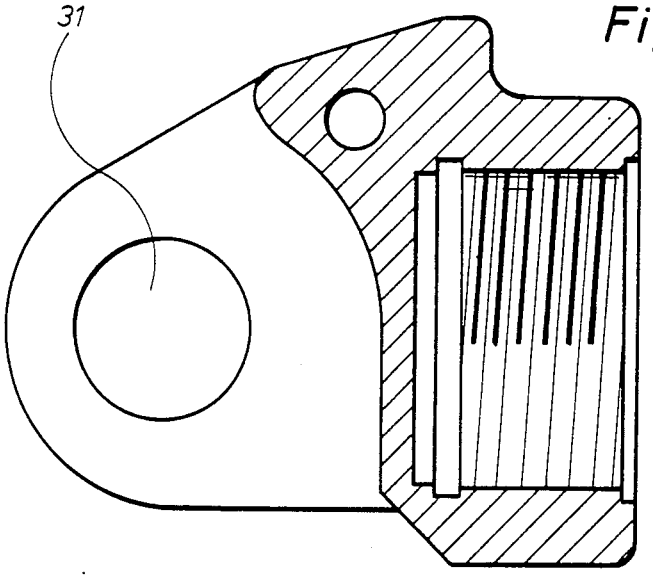
FIG. 4 is a sectional view taken on line B—B in FIG. 2 and shwoing the head piece.
Figure 5:
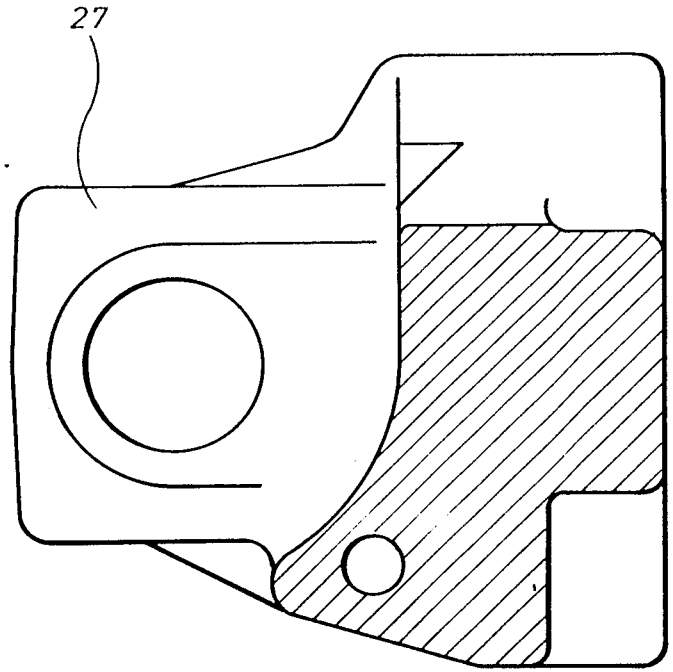
FIG. 5 is a sectional view taken on line C—C in FIG. 2 and showing the head piece.

Illustrative embodiments of the invention will now be explained more in detail with reference to the drawings.

The two-sided grab bucket shown in FIG. 1 comprises a U-shaped scoop carrier 1, which at its crossbeam 2 is connected in known manner to a bucket arm by means of a rotary hydraulic motor, not shown. Crosspieces 5 are bolted to the inside surfaces of the legs 3,4 and constitute the inner parts of the bearings for the shafts 8, 9, which stiffen the scoops 6, 7. The shells 11, 12 of said bearings are fixed to the crosspieces 5 by means of necked-down bolts 10.

Two slightly curved actuating levers 13 are welded to each of the shafts 8, 9 and at their free ends are pivoted by means of the pins 16 to the double-forked head pieces 14, 15 of the cylinders 17, 18. The pistons disposed in the cylinders 17, 18 are interconnected by a transversely extending, common piston rod 19, which is guided in bores of the head pieces 14, 15.

Each side wall of the scoops 6, 7 is provided at its top inner corner with a bore 20, which is smaller in diameter than the shafts 8, 9. At the inner edges of the bores 20, the side walls are welded to the end faces of the shafts 8, 9, which close the bores on the inside.

FIG. 2 is a top plan view showing one of the two head pieces 14, 15, which are identical to each other. Each head piece is provided on its rear with an annular extension 21, which is formed with female screw threads 22 in threaded engagement with male screw threads formed on the cylinder 17 or 18. The head piece is also formed with a bore 23, which is concentric to the annular extension 21. The piston rod 19 extends through the bore 23, the surfaces of which are provided with the seals for the piston rod.

Forked recesses 24, 25 are provided on opposite sides of the walls which define the bore 23. The actuating levers 13 are provided in pairs and have free ends, which are movably mounted in the recesses 24, 25, which are defined on one side by the walls defining the bore 23 and on the other side by the legs 26, 27, which are formed with bores 28, 29, which are aligned with each other. The walls defining the bore 23 are formed with blind holes 30, 31, which are equal in diameter to the bores 28, 29. The bores 28, 29 and the blind holes 30, 31 receive pivot pins for the actuating levers 13. Said pivot pins and the walls defining the bore 23 are formed with transverse bores 32, 33, which receive pins for locking the pivot pins.

Figure 6:
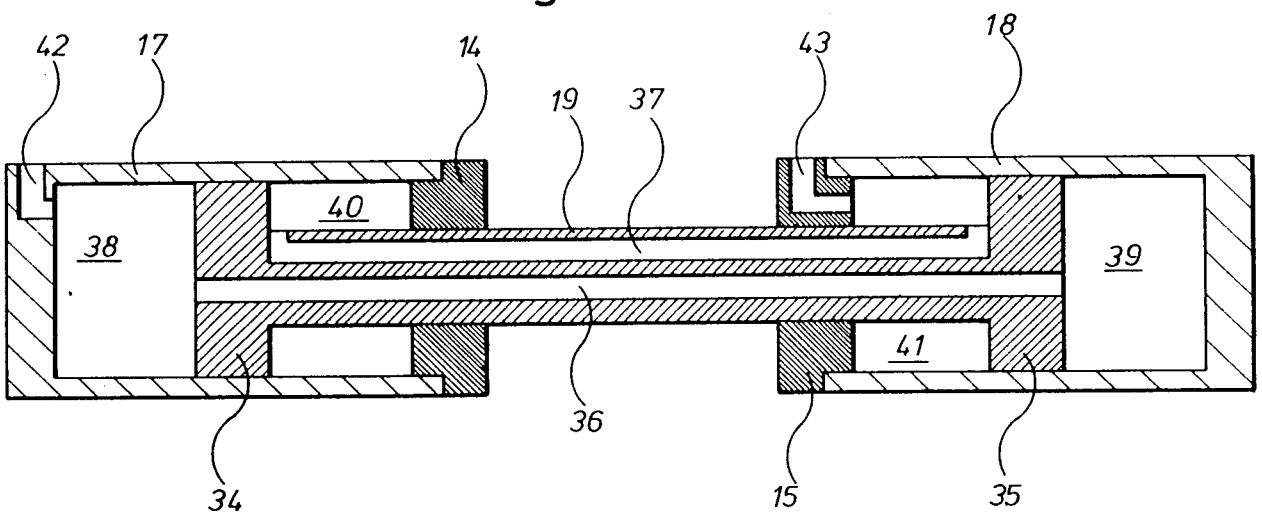
FIG. 6 is a longitudinal sectional view showing the piston-cylinder unit.

As is apparent from FIG. 6 the piston rod 19 is provided with parallel bores 36, 37, by which the chambers 38, 39 disposed behind the pistons 34, 35 and the chambers 40, 41 disposed in front of said pistons are respectively connected. The cylinder 17 is provided at its outer end with the port 42 and at the head piece 15 the cylinder 18 is provided with the port 43. The ports 42 and 43 are connected to respective supply lines 44, 45, which are laterally disposed and are shown in FIG. 7 after a rotation through 90°.

As is apparent from FIG. 11 the hydraulic hoses 45 are connected to ports provided on the sides of the head pieces.

In the arrangement shown in FIGS. 10 and 11 the hose lines 45 can be symmetrically connected so that the two-sided grab bucket will have an improved, more rugged appearance.

The arrangement of the hydraulic hoses between the rotary motor and the reciprocating cylinders is problematic. As the grab bucket is opened, the piston-cylinder units, the hoses and the rotary motor enter the scoops and the distance between the ports connecting the hoses to the rotary motor and to the cylinders is changed. Because the hoses must not contact the scoops during that operation if damage to and a wear of the hoses is to be avoided, the hydraulic hoses must be highly flexible if they should be short.

The arrangement of the hydraulic hoses shown in FIGS. 10 and 11 is particularly favorable because the hoses are connected to the heads of the associated cylinders at locations which are as close as possible to the center of the grab bucket. The hydraulic hoses are clearly arranged in mirror symmetry so that the grab bucket has a neat appearance and a high flexibility even if short hoses are employed.

I claim:

1. A two-sided grab bucket comprising a U-shaped scoop carrier having a pair of opposite depending legs a pair of scoops each of which includes opposite side walls and a crosspiece extending between and affixed to said side walls, said crosspieces being parallel and supported by said carrier legs for rotation about parallel axes, a pair of longitudinally spaced actuating levers affixed to and projecting transversely from each of said crosspieces, a piston-cylinder unit including a pair of cylinders and pistons and a common piston rod extending between and coupled to said pistons, each of said cylinders including an end head piece having a guide slidably engaging said piston rod and a pair of longitudinally spaced coaxial pivot pins mounted on each of said cylinder head pieces on opposite sides of said guide and rockably coupling each pair of said levers to a respective cylinder head piece, said head pieces being provided with yokelike recesses on both sides of the respective guides, opposite walls defining each of said recesses and having transverse coaxial bores engaging respective pins, and the ends of said actuating levers of each pair being affixed to each crosspiece and being pivoted to said pins.

2. A two-sided grab bucket according to claim 1, characterized in that one cylinder is provided adjacent to its outer end and the other cylinder is provided adjacent to its head piece with a bore for supplying and discharging hydraulic liquid, and the piston rod has two axial bores, one of which interconnects the chambers disposed behind the pistons and the other of which interconnects the chambers in front of the pistons.

3. A two-sided grab bucket according to claim 2, characterized in that the bore disposed adjacent to the outer end of one cylinder is connected by a line which is parallel to the cylinder to the bore at other cylinder the head piece end and the last-mentioned bore communicates with a hydraulic hose.

4. A two-sided grab according to claim 1, characterized in that fluid ports are provided on the sides of the cylinders.

5. A two-sided grab bucket according to claim 1, characterized in that the cylinders are provided with screw threads in threaded engagement with female screw threads in mating bores of respective head pieces.

* * * * *